US012692617B2

(12) United States Patent
Goto et al.

(10) Patent No.: US 12,692,617 B2
(45) Date of Patent: Jul. 28, 2026

(54) PLATING APPARATUS AND PLATING METHOD

(71) Applicant: EBARA CORPORATION, Tokyo (JP)

(72) Inventors: Yusui Goto, Tokyo (JP); Kazuhito Tsuji, Tokyo (JP); Mizuki Nagai, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 614 days.

(21) Appl. No.: 18/016,647

(22) PCT Filed: Feb. 16, 2022

(86) PCT No.: PCT/JP2022/006061

§ 371 (c)(1),
(2) Date: Jan. 17, 2023

(87) PCT Pub. No.: WO2023/157105

PCT Pub. Date: Aug. 24, 2023

(65) Prior Publication Data

US 2024/0254648 A1 Aug. 1, 2024

(51) Int. Cl.
*C25D 21/12* (2006.01)
*C25D 17/00* (2006.01)

(52) U.S. Cl.
CPC ..... *C25D 17/007* (2013.01); *C25D 21/12* (2013.01)

(58) Field of Classification Search
None
See application file for complete search history.

(56) References Cited

U.S. PATENT DOCUMENTS

2015/0211144 A1 7/2015 Feng et al.
2019/0093250 A1* 3/2019 Yamasaki ..... C25D 5/04

FOREIGN PATENT DOCUMENTS

| | | | |
|---|---|---|---|
| JP | S58-113399 | A | 7/1983 |
| JP | 2005-029863 | A | 2/2005 |
| JP | 2016-098399 | A | 5/2016 |
| JP | 2017-137519 | A | 8/2017 |
| JP | 2020-172682 | A | 10/2020 |
| WO | WO 2017/110432 | A1 | 6/2017 |

OTHER PUBLICATIONS

English translation JP 2017-137519 (Year: 2017).*
English translation JP 2005-029863 (Year: 2005).*
English translation WO 2019/021599 (Year: 2019).*
English translation JPH 11246999 (Year: 1999).*

* cited by examiner

*Primary Examiner* — Stefanie S Wittenberg
(74) *Attorney, Agent, or Firm* — BakerHostetler

(57) ABSTRACT

Provided are a plating apparatus and the like capable of improving the uniformity of a plating film formed on a substrate. The plating apparatus includes a plating tank, a substrate holder for holding a substrate, an anode holder disposed in the plating tank to face the substrate held in the substrate holder, the anode holder being configured to hold a soluble anode, an anode mask attached to the anode holder, the anode mask having an opening through which a current flowing between the anode and the substrate passes, an adjustment mechanism configured to adjust an opening dimension of the anode mask, and a controller that controls the adjustment mechanism based on an amount of electrolysis in the anode while the anode is in use.

7 Claims, 7 Drawing Sheets

PLATING APPARATUS AND PLATING METHOD

CROSS-REFERENCE TO RELATED APPLICATIONS

This application is a U.S. national phase application of International Patent Application No. PCT/JP2022/006061 filed Feb. 16, 2022, which is incorporated by reference in its entirety for any and all purposes.

TECHNICAL FIELD

The present application relates to a plating apparatus and a plating method.

BACKGROUND ART

Conventionally, a wiring is formed in a fine wiring groove, hole, or resist opening provided in a surface of a substrate such as a semiconductor wafer, or a bump (protruding electrode) electrically connected to a package electrode or the like is formed on the surface of the substrate. As a method of forming the wiring and the bump, for example, an electroplating method, a vapor deposition method, a printing method, a ball bump method, and the like are known. In recent years, with the increased number of I/Os in a semiconductor chip and a narrower pitch, the electroplating method in which miniaturization is possible and performance is comparatively stable has become more popular.

When the wiring or the bump is formed by the electroplating method, a seed layer (power feed layer) having low electrical resistance is formed on a surface of a barrier metal provided in the wiring groove, hole, or resist opening on the substrate. On the surface of this seed layer, a plating film grows. In recent years, with the miniaturization of the wiring and the bump, a seed layer having a smaller film thickness has been used. As the film thickness of the seed layer decreases, the electrical resistance (sheet resistance) of the seed layer increases.

In general, the substrate that is an object to be plated has a peripheral edge portion provided with an electrical contact. For this reason, a current flows through the central portion of the substrate, the current corresponding to a combined resistance having an electrical resistance value of a plating solution and an electrical resistance value of the seed layer from a central portion of the substrate to the electrical contact. On the other hand, a current almost corresponding to the electrical resistance value of the plating solution flows through the peripheral edge portion of the substrate (in the vicinity of the electrical contact). Specifically, the current is hard to flow through the central portion of the substrate by an amount of the electrical resistance value of the seed layer from the central portion of the substrate to the electrical contact. This phenomenon where the current is concentrated on the peripheral edge portion of the substrate is called a terminal effect.

A substrate including a seed layer having a comparatively small film thickness has a comparatively large electrical resistance value of a seed layer from a central portion of the substrate to an electrical contact. For this reason, w % ben plating is performed on the substrate including the seed layer having the comparatively small film thickness, the terminal effect becomes noticeable. As a result, a plating speed in the central portion of the substrate decreases, a film thickness of a plating film in the central portion of the substrate is smaller than that of a plating film in a peripheral edge portion of the substrate, and in-plane uniformity of the film thickness decreases.

To suppress the decrease in in-plane uniformity of the film thickness due to the terminal effect, an electric field applied to the substrate is adjusted. For example, a plating apparatus including an anode mask for adjusting the potential distribution in an anode surface is known (see PTL 1).

CITATION LIST

Patent Literature

PTL 1: Japanese Patent Laid-Open No. 2017-137519

SUMMARY OF INVENTION

Technical Problem

Now, as an anode, a soluble anode that dissolves by a plating current is widely used. Through research by the present inventors, it has been found that, when electroplating is performed using the soluble anode, the in-plane uniformity of a plating film thickness changes with dissolution of the anode. Specifically, the soluble anode dissolves with progress of the plating, and the distance between a substrate and the anode changes. Then, it has been found that the change in the distance between the substrate and the anode changes an electrical resistance value through a plating solution, and also changes the in-plane uniformity of the film thickness.

In view of the above circumstances, one of objects of the present application is to provide a plating apparatus and the like capable of improving uniformity of a plating film formed on a substrate.

Solution to Problem

According to one embodiment, a plating apparatus is provided, and the plating apparatus includes a plating tank, a substrate holder for holding a substrate, an anode holder disposed in the plating tank to face the substrate held in the substrate holder, the anode holder being configured to hold a soluble anode, an anode mask attached to the anode holder, the anode mask having an opening through which a current flowing between the anode and the substrate passes, an adjustment mechanism configured to adjust an opening dimension of the anode mask, and a controller that controls the adjustment mechanism based on an amount of electrolysis in the anode while the anode is in use.

According to another embodiment, a plating method in a plating apparatus is provided. The plating apparatus includes a plating tank, a substrate holder for holding a substrate, an anode holder disposed in the plating tank to face the substrate held in the substrate holder, the anode holder being configured to hold a soluble anode, and an anode mask attached to the anode holder, the anode mask having an opening through which a current flowing between the anode and the substrate passes. Then, the plating method includes obtaining or estimating an amount of electrolysis in the anode while the anode is in use, and adjusting an opening dimension of the anode mask based on the obtained or estimated amount of electrolysis.

DESCRIPTION OF EMBODIMENTS

Figure 1:
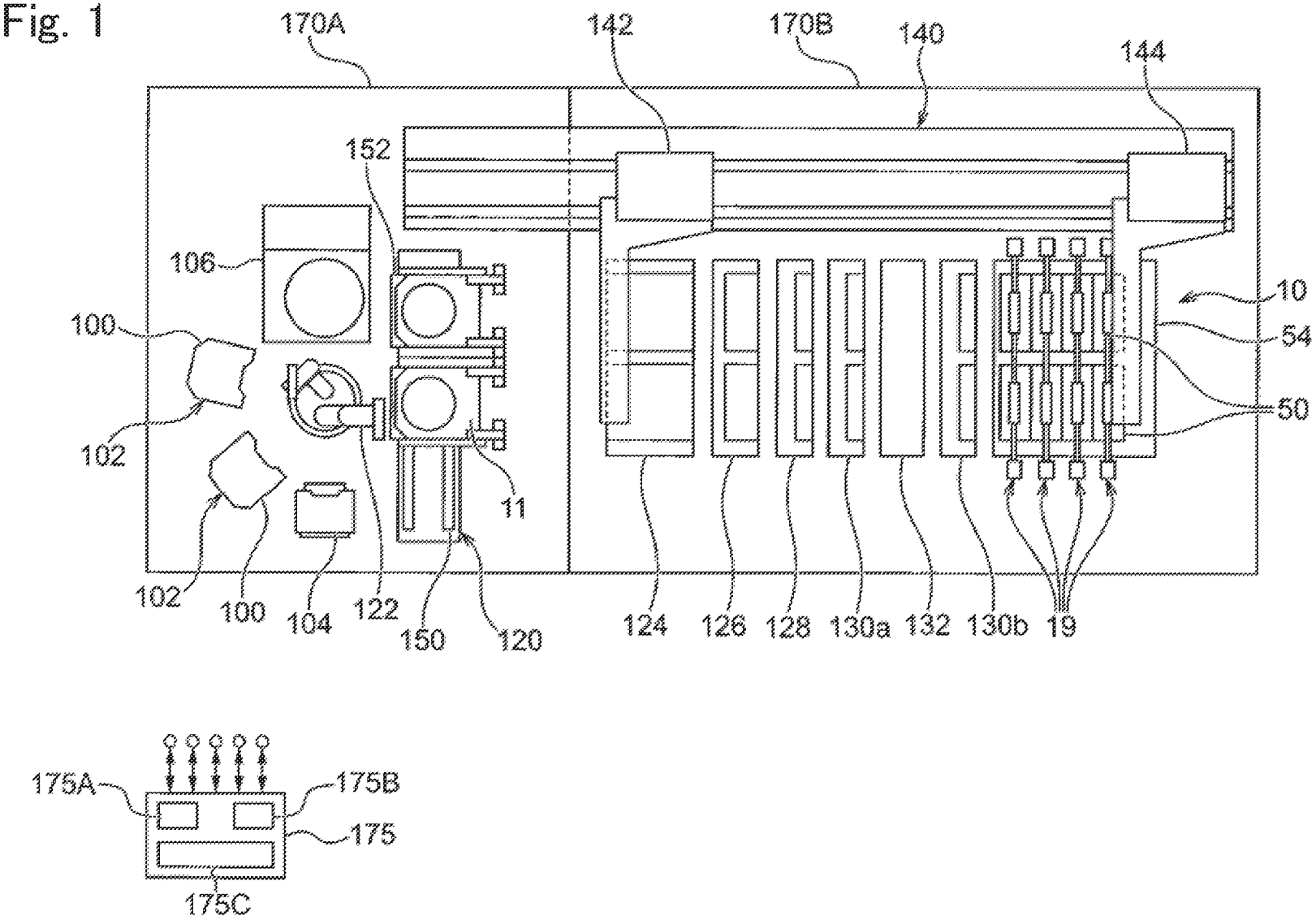
FIG. 1 is an overall arrangement diagram of a plating apparatus in a first embodiment.

Hereinafter, embodiments of the present invention will be described with reference to the drawings. In the drawings described below, the same or corresponding components are denoted with the same reference signs and are not described in duplicate.

First Embodiment

FIG. 1 is an overall arrangement diagram of a plating apparatus in a first embodiment. A plating object in the present embodiment is a substrate such as a semiconductor wafer. Examples of the substrate include a rectangular substrate such as a quadrangular or hexagonal substrate, and a circular substrate. As shown in FIG. 1, this plating apparatus is broadly divided into a load port 170A that loads the substrate into a substrate holder 11 or unloads the substrate from the substrate holder 11, and a processing unit 170B that processes the substrate.

The load port 170A includes two cassette tables 102, an aligner 104, and a spin rinse dryer 106. On each cassette table 102, a cassette 100 containing a substrate such as a semiconductor wafer is mounted. The aligner 104 is provided to align positions of an orientation flat, a notch and others of the substrate in a predetermined direction. The spin rinse dryer 106 is provided for rotating the substrate after plating processing, at a high speed to dry the substrate. Near the spin rinse dryer 106, a substrate attaching/detaching mechanism 120 is provided for placing the substrate holder 11 to attach and detach the substrate. In a center of these units 100, 104, 106, and 120, a substrate transfer device 122 including a transferring robot that transfers the substrate between these units is disposed.

The substrate attaching/detaching mechanism 120 includes a flat plate-shaped placing plate 152 that is slidable in a lateral direction along a rail 150. Two substrate holders 11 are placed in parallel in a horizontal state on the placing plate 152. Then, after the substrate is delivered between one of the substrate holders 11 and the substrate transfer device 122, the placing plate 152 is slid in the lateral direction, and the substrate is delivered between the other substrate holder 11 and the substrate transfer device 122.

The processing unit 170B of the plating apparatus includes a stocker 124, a prewet tank 126, a presoak tank 128, a first cleaning tank 130*a*, a blow tank 132, a second cleaning tank 130*b*, and a plating tank 50 in a plating module 10. In the stocker 124, the substrate holder 11 is stocked and temporarily placed. In the prewet tank 126, the substrate is immersed in pure water. In the presoak tank 128, an oxide film on the surface of a conductive layer such as a seed layer formed on the surface of the substrate is removed by etching. In the first cleaning tank 130*a*, the presoaked substrate is cleaned with a cleaning solution (pure water or the like) together with the substrate holder 11. In the blow tank 132, the cleaned substrate is drained. In the second cleaning tank 130*b*, the plated substrate is cleaned with the cleaning solution together with the substrate holder 11. The stocker 124, the prewet tank 126, the presoak tank 128, the first cleaning tank 130*a*, the blow tank 132, the second cleaning tank 130*b* and the plating tank 50 are arranged in this order as an example.

The plating module 10 includes, for example, a plurality of plating tanks 50 including an overflow tank 54. Each plating tank 50 houses one substrate inside, immerses the substrate in the plating solution held inside, and performs plating such as copper plating on the substrate surface.

The plating apparatus includes a substrate holder transfer device 140 adopting, for example, a linear motor system that is located on a side of each unit of equipment and that transfers the substrate holder 11 together with the substrate between respective units of equipment. The substrate holder transfer device 140 includes a first transporter 142 and a second transporter 144. The first transporter 142 is configured to transfer the substrate to and from the substrate attaching/detaching mechanism 120, the stocker 124, the prewet tank 126, the presoak tank 128, the first cleaning tank 130*a*, and the blow tank 132. The second transporter 144 is configured to transfer the substrate to and from the first cleaning tank 130*a*, the second cleaning tank 130*b*, the blow tank 132, and the plating tank 50. In another embodiment, the plating apparatus may only include any one of the first transporter 142 and the second transporter 144.

On opposite sides of the overflow tank 54, paddle drive devices 19 for driving paddles 18 (see FIG. 2) as stirring rods located in the respective plating tanks 50 to stir the plating solution in the plating tanks 50 are arranged, respectively.

The plating apparatus includes a controller 175 configured to control each part described above. The controller 175 includes a memory 175B in which a predetermined program is stored, a central processing unit (CPU) 175A that executes the program in the memory 175B, and a control unit 175C realized by the CPU 175A executing the program. For example, the control unit 175C can perform transfer control of the substrate transfer device 122, transfer control of the substrate holder transfer device 140, control of a plating current and plating time in the plating module 10, control of an opening diameter of an after-mentioned anode mask 25 and an opening diameter of an after-mentioned regulation plate 30, and the like. As an example, the controller 175 is configured to be able to communicate with an unshown host controller that generally controls the plating apparatus and other related devices and can exchange data with a database the host controller has.

Figure 2:
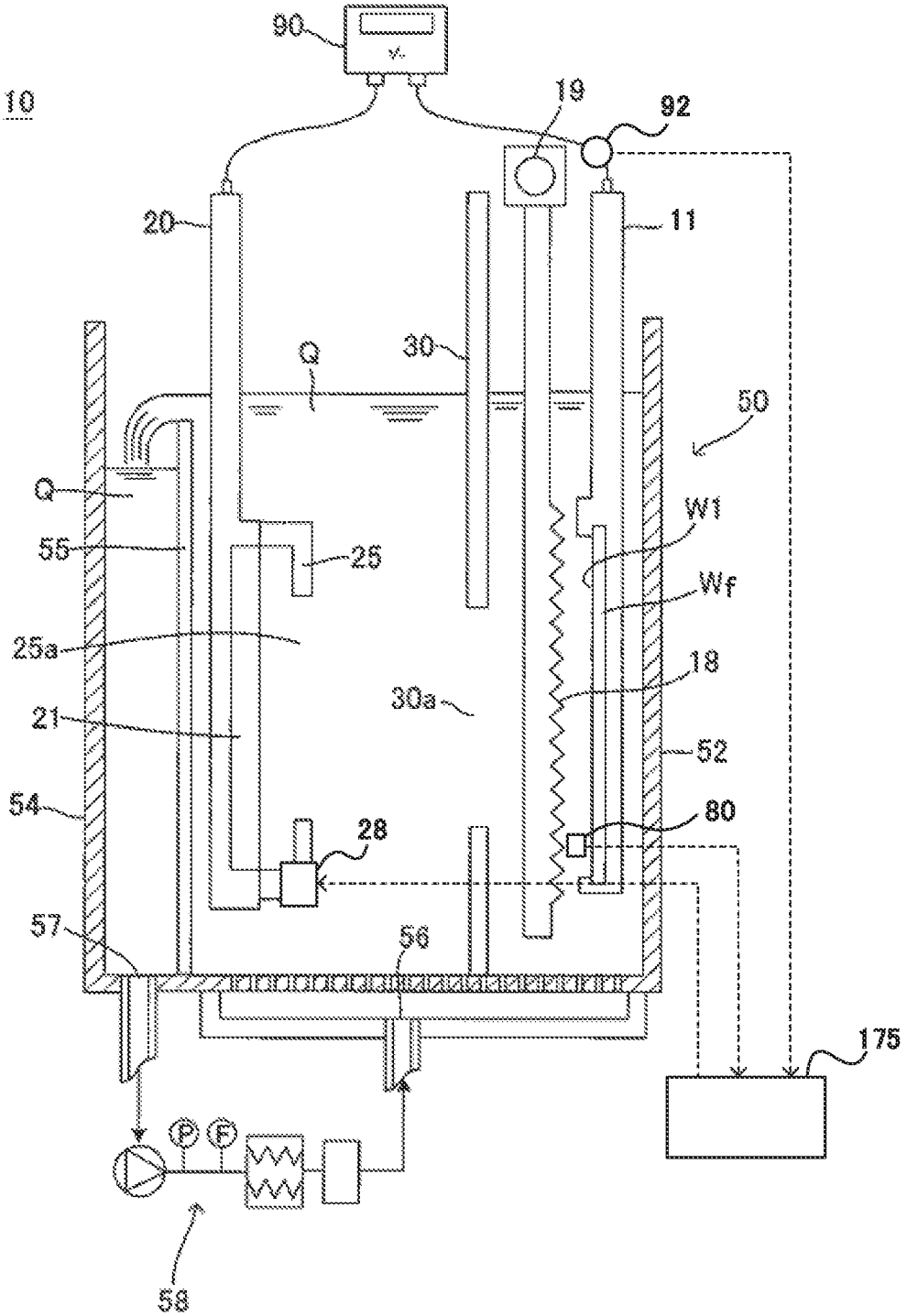
FIG. 2 is a schematic cross-sectional side view of a plating module 10 shown in FIG. 1.

FIG. 2 is a schematic cross-sectional side view of the plating module 10 shown in FIG. 1. As shown in the drawing, the plating module 10 includes the plating tank 50 in which a plating solution Q is accumulated, the substrate holder 11 configured to hold a substrate Wf, and an anode holder 20 configured to hold an anode 21.

The plating tank 50 includes a plating processing tank 52 in which the plating solution Q containing an additive is accumulated, the overflow tank 54 that receives and discharges the plating solution Q that overflows from the plating processing tank 52, and a partition wall 55 that partitions the plating processing tank 52 and the overflow tank 54.

The anode holder 20 is disposed in the plating tank 50 to face the substrate Wf held in the substrate holder 11. The anode holder 20 holds the anode 21 having about the same plate surface dimension as that of the substrate Wf. In the present embodiment, a soluble anode is used as the anode 21. The anode holder 20 holding the anode 21 and the substrate holder 11 holding the substrate Wf are immersed in the plating solution Q in the plating processing tank 52 and provided facing each other so that the anode 21 and a surface to be plated W1 of the substrate Wf are substantially parallel. To the anode 21 and the substrate Wf in a state of being immersed in the plating solution Q of the plating processing tank 52, a voltage is applied by a plating power source 90. Thereby, metal ions are reduced in the surface to be plated W1 of the substrate Wf, and a film is formed on the surface to be plated W1. The plating power source 90 is controlled by the controller 175 shown in FIG. 1. The plating power source 90 may be provided with a current sensor 92 for measuring a value of a current flowing from the plating power source 90. In the present embodiment, a detected value by the current sensor 92 is input into the controller 175.

The plating processing tank 52 has a plating solution supply port 56 for supplying the plating solution Q into the tank. The overflow tank 54 has a plating solution discharge port 57 for discharging the plating solution Q that overflows from the plating processing tank 52. The plating solution supply port 56 is disposed in a bottom portion of the plating processing tank 52, and the plating solution discharge port 57 is disposed in a bottom portion of the overflow tank 54.

When the plating solution Q is supplied from the plating solution supply port 56 to the plating processing tank 52, the plating solution Q overflows from the plating processing tank 52 and flows across the partition wall 55 into the overflow tank 54. The plating solution Q flowing into the overflow tank 54 is discharged from the plating solution discharge port 57, and impurities are removed through a filter or the like a plating solution circulation device 58 has. The plating solution Q from which the impurities are removed is supplied to the plating processing tank 52 through the plating solution supply port 56 by the plating solution circulation device 58.

The anode holder 20 has the anode mask 25 for adjusting an electric field between the anode 21 and the substrate Wf. The anode mask 25 is, for example, a substantially plate-shaped member made of a dielectric material and is provided on a front surface of the anode holder 20. Here, the front surface of the anode holder 20 refers to the surface on a side that faces the substrate holder 11. Specifically, the anode mask 25 is disposed between the anode 21 and the substrate holder 11. The anode mask 25 has, in a substantially central portion, a first opening 25*a* through which a current flowing between the anode 21 and the substrate Wf passes. The first opening 25*a* preferably has an opening shape corresponding to the plate surface shape of the anode 21. A dimension of the first opening 25*a* is preferably smaller than a dimension of the anode 21. As will be described later, the dimension of the first opening 25*a* is configured to be adjustable by an adjustment mechanism 28. In the present embodiment. "the dimension" means the diameter or radius when the substrate Wf or the opening is circular. Further, in the present embodiment, "the dimension" means a length of one side, or an opening width that is the smallest opening width passing through a center, when the substrate Wf or the opening is rectangular. Alternatively, the dimension of the first opening 25*a* can be defined by the diameter of a circle having an area equivalent to an opening area.

The plating module 10 further includes the regulation plate 30 for adjusting the electric field between the anode 21 and the substrate Wf. The regulation plate 30 is, for example, a substantially plate-shaped member made of a dielectric material and is disposed between the anode mask 25 and the substrate holder 11 (substrate Wf). The regulation plate 30 has a second opening 30*a* through which the current flowing between the anode 21 and the substrate Wf passes. A dimension of the second opening 30*a* is preferably smaller than a dimension of the substrate Wf. As will be described later, the diameter of the second opening 30*a* is configured to be adjustable.

The regulation plate 30 is preferably located closer to the substrate holder 11 than an intermediate position between the anode holder 20 and the substrate holder 11. When the regulation plate 30 is disposed at a position closer to the substrate holder 11, a film thickness of a peripheral edge portion of the substrate Wf can be more accurately controlled by adjusting the diameter of the second opening 30*a* of the regulation plate 30.

The paddle 18 for stirring the plating solution Q in the vicinity of the surface to be plated W1 of the substrate Wf is provided between the regulation plate 30 and the substrate holder 11. The paddle 18 is a substantially rod-shaped member and is provided in the plating processing tank 52 to face in a vertical direction. One end of the paddle 18 is fixed to the paddle drive device 19. As an example, the paddle 18 is horizontally moved along the surface to be plated W1 of the substrate Wf by the paddle drive device 19, thereby stirring the plating solution Q.

Figure 3:
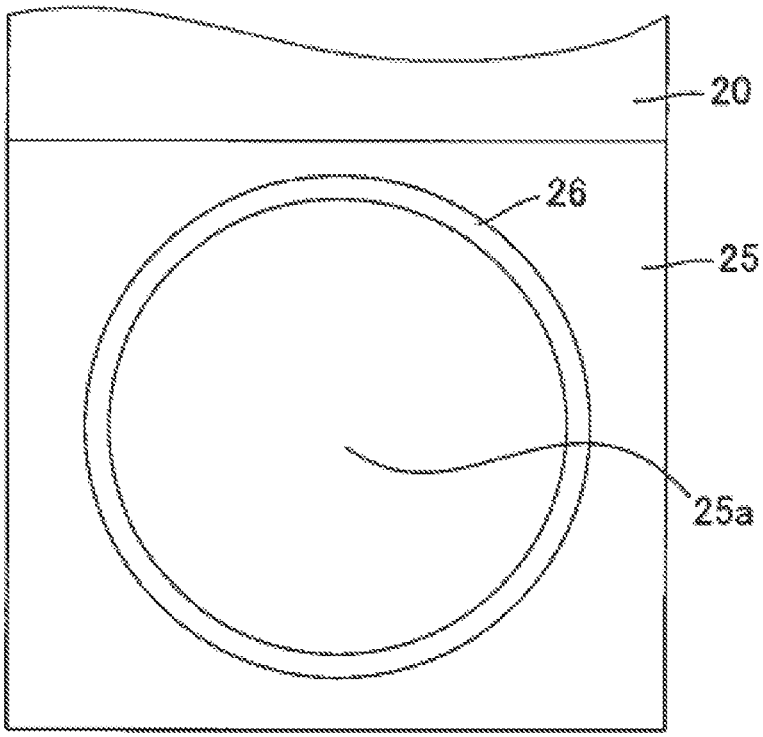
FIG. 3 is a schematic front view of an anode mask and shows the anode mask in a case where the dimension of a first opening is comparatively large.
Figure 4:
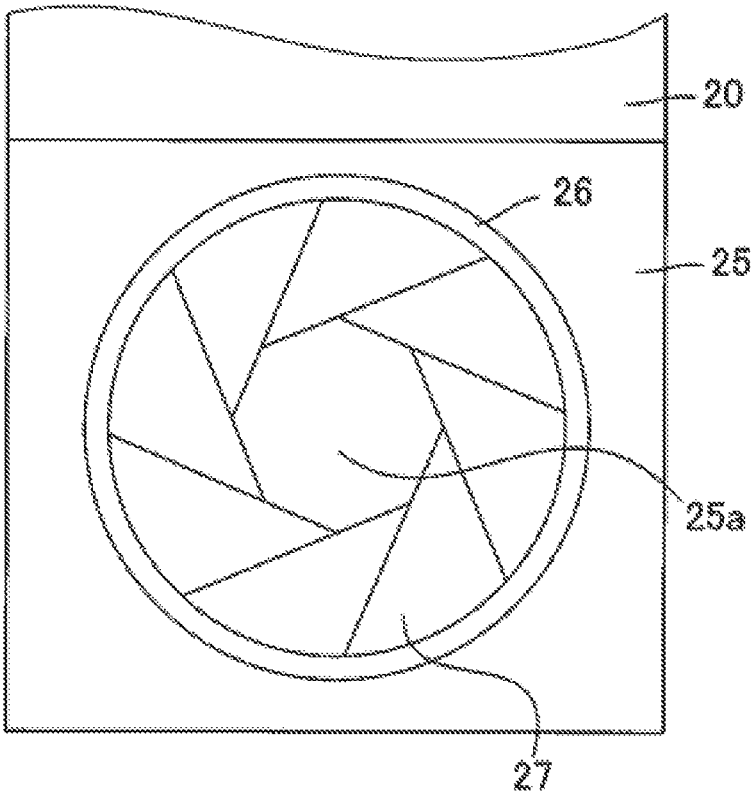
FIG. 4 is a schematic front view of the anode mask and shows the anode mask in a case where the dimension of the first opening is comparatively small.

Next, the anode mask 25 shown in FIG. 2 will be described in detail. FIGS. 3 and 4 are schematic front views of the anode mask 25. FIG. 3 shows the anode mask 25 when the dimension of the first opening 25*a* is comparatively large. FIG. 4 shows the anode mask 25 when the dimension of the first opening 25*a* is comparatively small. Here, the smaller the first opening 25*a* of the anode mask 25 is, the more the current flowing from the anode 21 to the substrate Wf is concentrated on the central portion of the surface to be plated W1 of the substrate Wf. Therefore, there is a tendency that when the first opening 25*a* is made smaller, the film thickness of the central portion of the surface to be plated W1 of the substrate Wf increases, and when the first opening 25*a* is made larger, the film thickness of the central portion of the surface to be plated W1 of the substrate Wf decreases.

As shown in FIG. 3, the anode mask 25 has a substantially annular edge portion 26. A size of the dimension of the first opening 25*a* of the anode mask 25 shown in FIG. 3 is maximized. The dimension of the first opening 25*a* in this case matches the inner dimension of the edge portion 26.

As shown in FIG. 4, the anode mask 25 has a plurality of aperture blades 27 (corresponding to an example of the adjustment mechanism 28) that can adjust the dimension of the first opening 25*a*. The aperture blades 27 cooperate to define the first opening 25*a*. Each of the aperture blades 27 enlarges or reduces the dimension of the first opening 25*a* by a structure similar to an aperture mechanism of a camera (that is, adjusts the dimension of the first opening 25*a*). The first opening 25*a* of the anode mask 25 shown in FIG. 4 is formed in a non-circular shape (for example, a polygonal shape) by the aperture blades 27.

Each of the aperture blades 27 is driven and controlled by the controller 175 shown in FIG. 2, to increase or decrease the diameter of the first opening 25*a*. For example, each of the aperture blades 27 may be configured to be driven using air pressure or an electric drive power. A first adjustment mechanism using the aperture blade 27 has a characteristic of being able to vary the first opening 25*a* in a comparatively wide range. Further, when the substrate is circular, it is desirable that the first opening 25*a* of the anode mask 25 is circular. However, maintaining a perfect circular shape in the entire range from the minimum diameter to the maximum diameter of the first opening 25*a* involves mechanical difficulties. In general, when the opening through which the current flowing between the anode 21 and the substrate Wf passes is not perfectly circular, the electric field is azimuthally uneven, and a shape of the opening may be transcribed to the plating film thickness distribution formed in the peripheral edge portion of the substrate Wf. However, since the anode mask 25 is integrally attached to the anode holder 20, a sufficient distance from the substrate can be taken, and even if the opening is not perfectly circular, impact on the plating film thickness distribution can be maximally suppressed.

Figure 5A:
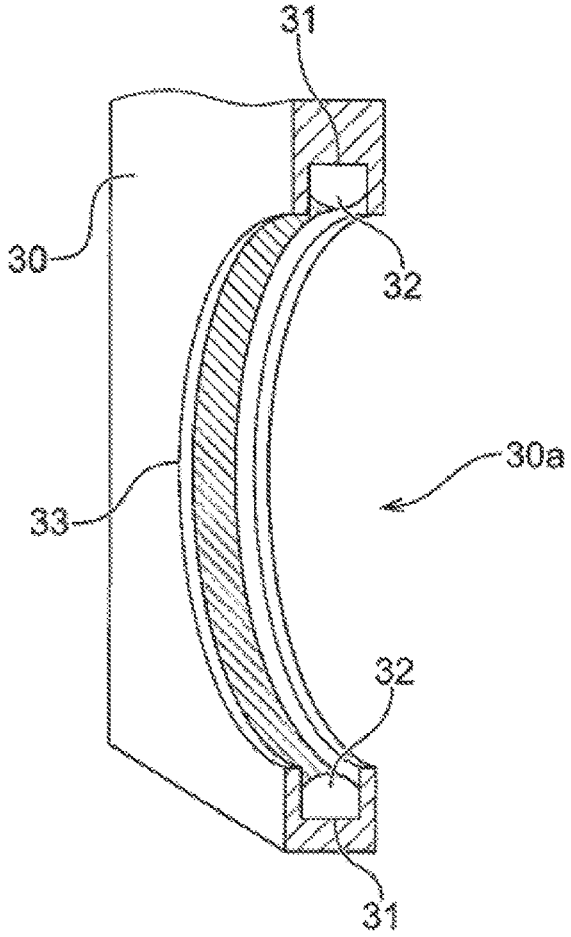
FIG. 5A is a partial cross-sectional side view of a regulation plate in a state where the diameter of a second opening is comparatively large.
Figure 5B:
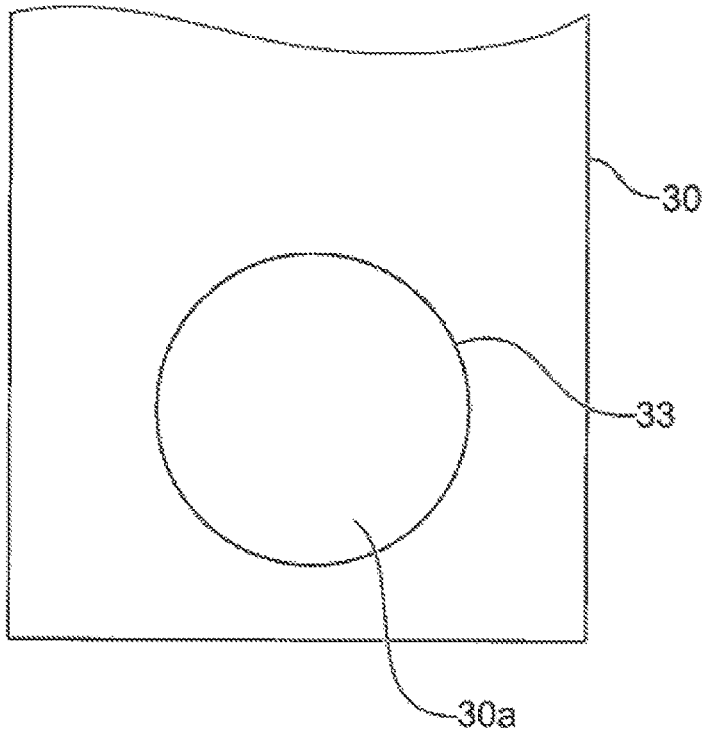
FIG. 5B is a plan view of the regulation plate in the state where the diameter of the second opening is comparatively large.
Figure 6A:
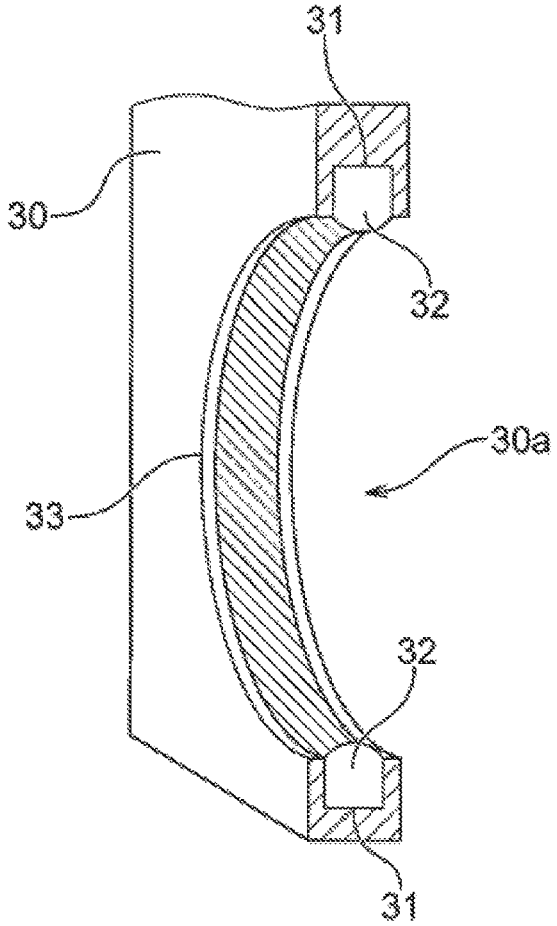
FIG. 6A is a partial cross-sectional side view of the regulation plate in a state where the diameter of the second opening is comparatively small.
Figure 6B:
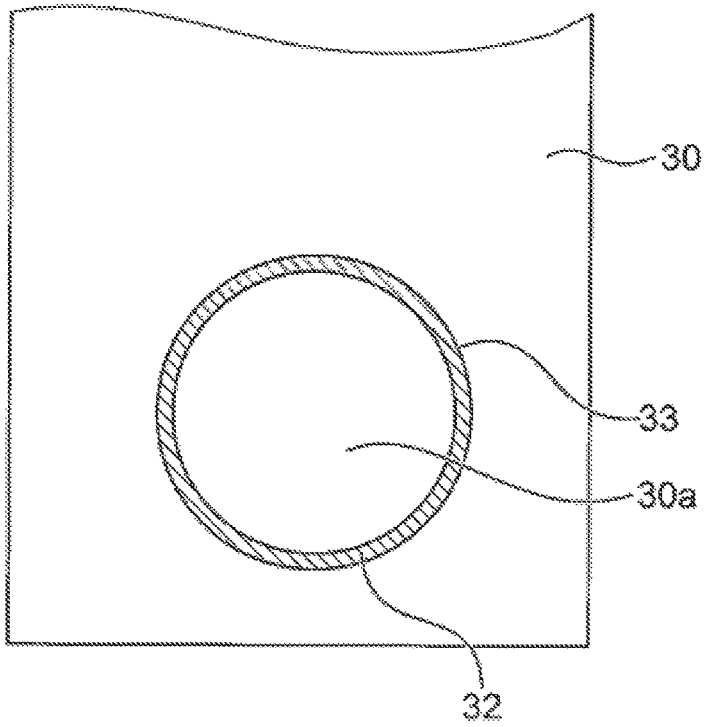
FIG. 6B is a plan view of the regulation plate in the state where the diameter of the second opening is comparatively small.

Next, the regulation plate 30 shown in FIG. 2 will be described in detail. FIG. 5A is a partial cross-sectional side view of the regulation plate 30 in a state where the diameter of the second opening 30*a* is comparatively large, and FIG. 5B is a plan view of the regulation plate 30 in the state where the diameter of the second opening 30*a* is comparatively large. FIG. 6A is a partial cross-sectional side view of the regulation plate 30 in a state where the diameter of the second opening 30*a* is comparatively small, and FIG. 6B is a plan view of the regulation plate 30 in the state where the diameter of the second opening 30*a* is comparatively small. Here, the regulation plate 30 is provided at a position closer to the substrate Wf than the anode mask 25. For this reason, the plating current passing through the second opening 30*a* of the regulation plate 30 is hard to diffuse to the peripheral edge portion of the substrate Wf. Therefore, when the diameter of the second opening 30*a* of the regulation plate 30 is decreased, the film thickness of the peripheral edge portion of the substrate Wf can be decreased, and when the diameter of the second opening 30*a* is increased, the film thickness of the peripheral edge portion of the substrate Wf can be increased.

As shown in FIGS. 5A and 5B, the regulation plate 30 has a substantially annular edge portion 33 and a groove 31 along the second opening 30*a*. The regulation plate 30 also includes an elastic tube 32 (corresponding to an example of the adjustment mechanism 28) configured to be able to adjust the diameter of the second opening 30*a*. Specifically, the elastic tube 32 is provided along the second opening 30*a*, has an outer peripheral portion fixed to the groove 31 and is accordingly disposed in the groove 31. The elastic tube 32 is, for example, formed of an elastic member such as a resin and has a substantially annular shape. The elastic tube 32 has a hollow inside and is configured to be able to hold a fluid (gas such as air or nitrogen, or fluid such as water) inside. The elastic tube 32 has an unshown injection port for injecting the fluid to the interior of the tube and an unshown discharge port for discharging the fluid from the interior of the tube. The fluid is injected and discharged when the controller 175 controls an unshown fluid supply device.

In the regulation plate 30 shown in FIGS. 5A and 5B, the elastic tube 32 contains a comparatively small amount of fluid inside, and the elastic tube 32 is in a contracted state. For this reason, as shown in FIG. 5B, the diameter of the second opening 30*a* of the regulation plate 30 matches the inner diameter of the edge portion 33.

The elastic tube 32 has an outer periphery in contact with the groove 31, and hence when the fluid is injected to the interior of the elastic tube 32, the elastic tube 32 expands inward in a radial direction as shown in FIGS. 6A and 6B. As the elastic tube 32 expands inward in the radial direction, as shown in FIG. 6B, the inner diameter of the elastic tube 32 matches the diameter of the second opening 30*a*.

On the other hand, in a state where the elastic tube 32 shown in FIGS. 6A and 6B is expanded, the elastic tube 32 contracts as shown in FIGS. 5A and 5B by discharging the fluid from the interior of the elastic tube 32. Thus, the elastic tube 32 adjusts the diameter of the second opening 30*a* by injecting fluid to an interior of the elastic tube 32 or discharging fluid from the interior of the elastic tube 32. According to the elastic tube 32, the diameter of the second opening 30*a* can be adjusted with a simple configuration without using any mechanical structure.

When adopting a configuration that adjusts the pressure of an interior of an elastic body as the adjustment mechanism 28, the diameter of the opening can be changed while keeping the shape of the opening circular as compared to the configuration using the aperture blades 27. Thereby, even if an azimuthally uneven electric field is formed between the anode mask 25 and the regulation plate 30, the regulation plate 30 is provided between the anode mask 25 and the substrate, and hence a uniform plating film can be formed in the peripheral edge portion of the substrate.

In the present embodiment, the aperture blade 27 is adopted as the adjustment mechanism 28 in the anode mask 25, and an elastic body is adopted in the regulation plate 30. However, the present embodiment is not limited to such examples, the elastic body may be adopted in the anode mask 25, and the aperture blade 27 may be adopted in the regulation plate 30. Further, another mechanism may be adopted as the adjustment mechanism 28 as long as the mechanism can adjust the opening dimension of the anode mask 25 or the opening dimension of the regulation plate 30.

Next, description will be made as to a process of performing the plating processing on the substrate Wf with the plating module 10 shown in FIG. 2. As described above, an impact of terminal effect differs with characteristics of the substrate Wf, conditions for processing the substrate Wf, and the like. For this reason, when performing plating on a plurality of substrates Wf having different impacts of terminal effect in a single plating tank 50, in order to suppress decrease in in-plane uniformity of the film thickness due to the terminal effect, it is necessary to adjust the electric field applied to the substrate Wf in accordance with the characteristics of each substrate Wf, the conditions for processing the substrate Wf, and the like.

In the plating module 10, by adjusting at least one of the diameter of the first opening 25*a* of the anode mask 25 and the diameter of the second opening 30*a* of the regulation plate 30 depending on the characteristics of the substrate Wf or the conditions for processing the substrate Wf, the in-plane uniformity of the plating film of the substrate Wf can be improved. Then, in particular, in the present embodiment, the plating module 10 changes the diameter of the first opening 25*a* of the anode mask 25 based on an amount of electrolysis in the anode 21 while the anode 21 is in use (hereinafter also referred to as "a total amount of electrolysis in the anode). Here, "while the anode 21 is in use" can be rephrased as "from when the anode 21 is newly provided or replaced to the present". The amount of electrolysis in the anode 21 is generated mainly by the current flowing between the anode 21 and the substrate Wf as a cathode.

As an example, the total amount of electrolysis in the anode may be measured or calculated in real time during the plating processing or may be measured or calculated each time the plating processing of one or a predetermined number of substrates Wf ends. The amount of electrolysis in the anode 21 can be measured or calculated by various known methods. As an example, the amount of electrolysis in the anode 21 may be predetermined by experiment, simulation or the like depending on plating processing recipe (for example, a plating current value, plating time, substrate type, or plating solution type), and the total amount of electrolysis in the anode may be calculated by integrating the amount of electrolysis for each plating processing. As another example, the amount of electrolysis in the anode 21 may be calculated based on the value of a current flowing from the plating power source 90 through the anode 21 that is measured by the current sensor 92, and the total amount of electrolysis in the anode may be calculated by integrating the calculated amount of electrolysis.

The plating module 10 changes the diameter of the first opening 25*a* of the anode mask 25 based on the calculated total amount of electrolysis in the anode. This is based on the fact that the larger the total amount of electrolysis in the anode is, the larger an interpolar distance between the anode 21 and the substrate Wf as the cathode becomes because the anode 21 dissolves. In the present embodiment, a relationship between the total amount of electrolysis in the anode and the diameter of the first opening 25*a* of the anode mask 25 is predetermined and prestored in the memory 175B of the controller 175. Here, the relationship between the total amount of electrolysis in the anode and the diameter of the first opening 25*a* of the anode mask 25 may be stored in the memory 175B, as a map, table, or relational expression, as an example. Then, the controller 175 derives the diameter of the first opening 25*a* of the anode mask 25 based on the amount of electrolysis in the anode and the relationship stored in the memory 175B, and outputs a drive command to the adjustment mechanism 28.

Figure 7:
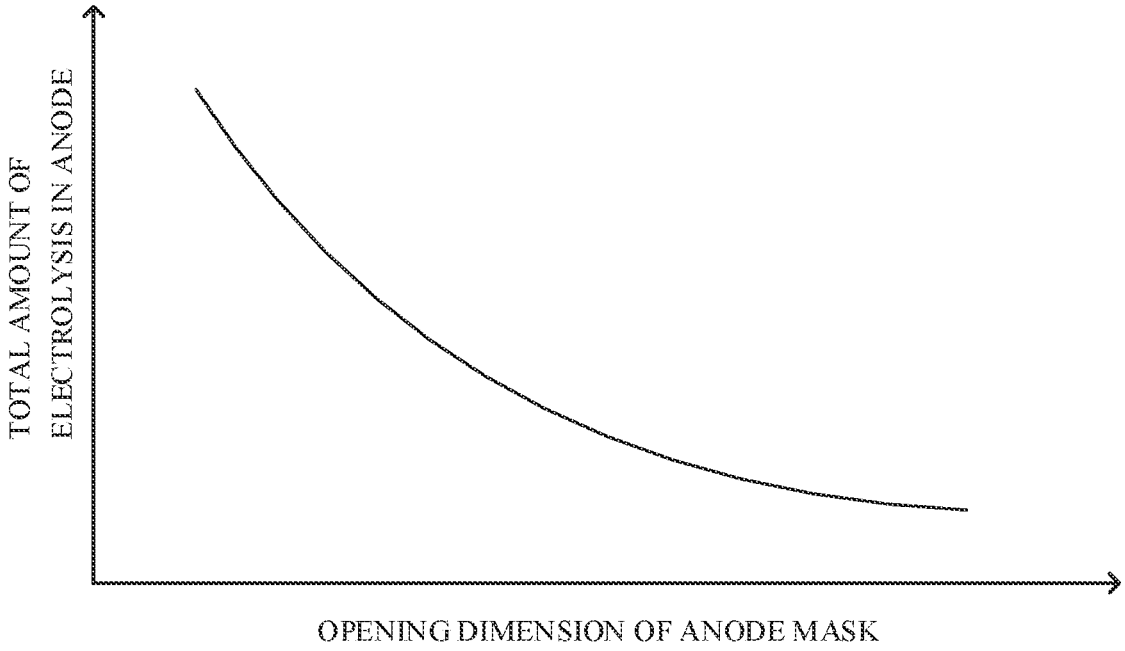
FIG. 7 is a diagram illustrating an example of the relationship between the total amount of electrolysis in an anode and the diameter of the first opening of the anode mask.

FIG. 7 is a diagram illustrating an example of the relationship between the total amount of electrolysis in the anode and the diameter of the first opening 25*a* of the anode mask 25. As shown in FIG. 7, the diameter of the first opening 25*a* of the anode mask 25 is determined to be smaller as the total amount of electrolysis in the anode increases. Through the research by the present inventors, it has been found that when the distance between the anode 21 and the substrate Wf is shorter than a proper distance, the plating film thickness near the center of the substrate Wf becomes relatively large. Conversely, it has been found that when the distance between the anode 21 and the substrate Wf is larger than the proper distance, the plating film thickness in the peripheral edge portion of the substrate Wf becomes relatively large. Further, it has been found that when the opening diameter of the anode mask 25 is increased, the plating film thickness in a central portion of the substrate Wf becomes relatively small, and the plating film thickness in the peripheral edge portion of the substrate Wf becomes relatively large. Conversely, it has been found that when the opening diameter of the anode mask 25 is decreased, the plating film thickness in the central portion of the substrate Wf becomes relatively large, and the plating film thickness in the peripheral edge portion of the substrate Wf becomes relatively small. From these findings, in the present embodiment, it is estimated that the larger the total amount of electrolysis in the anode is, the larger the distance between the anode 21 and the substrate Wf becomes, and the opening diameter of the anode mask 25 is decreased to achieve the uniformity of the plating film thickness. However, depending on the plating processing recipe, the relationship between the total amount of electrolysis in the anode and the opening diameter of the anode mask is not necessarily optimal in such an example. Therefore, the relationship between the total amount of electrolysis in the anode and the opening diameter of the anode mask may be suitably determined by the experiment, simulation or the like. In the example shown in FIG. 7, the diameter of the first opening 25*a* of the anode mask 25 is assumed to smoothly change to a tendency that the larger the total amount of electrolysis in the anode is, the smaller the diameter becomes. However, the present embodiment is not limited to this example, and the diameter of the first opening 25*a* may change stepwise in two or more steps depending on the total amount of electrolysis in the anode.

When the total amount of electrolysis in the anode reaches a predetermined maintenance threshold or more, the controller 175 may notify the outside via an unshown display or the like so as to prompt maintenance or replacement of the anode 21. Thereby, the maintenance or replacement of the anode 21 can be performed at an appropriate timing. When the anode 21 is replaced, the controller 175 may reset the total amount of electrolysis in the anode to a value of 0. As an example, when replacing the anode 21, a user or maintenance worker of the plating apparatus may make an input indicating the replacement into the controller 175.

As described above, in the plating apparatus and plating method of the present embodiment, the amount of electrolysis in the anode while the anode 21 is in use is calculated, and the opening diameter of the anode mask 25 is adjusted based on the calculated amount of electrolysis. Thereby, variations in uniformity of the plating film formed on the substrate Wf with the use of the anode 21 can be inhibited from being generated, and improvement of the uniformity of the plating film can be achieved.

Second Embodiment

Figure 8:
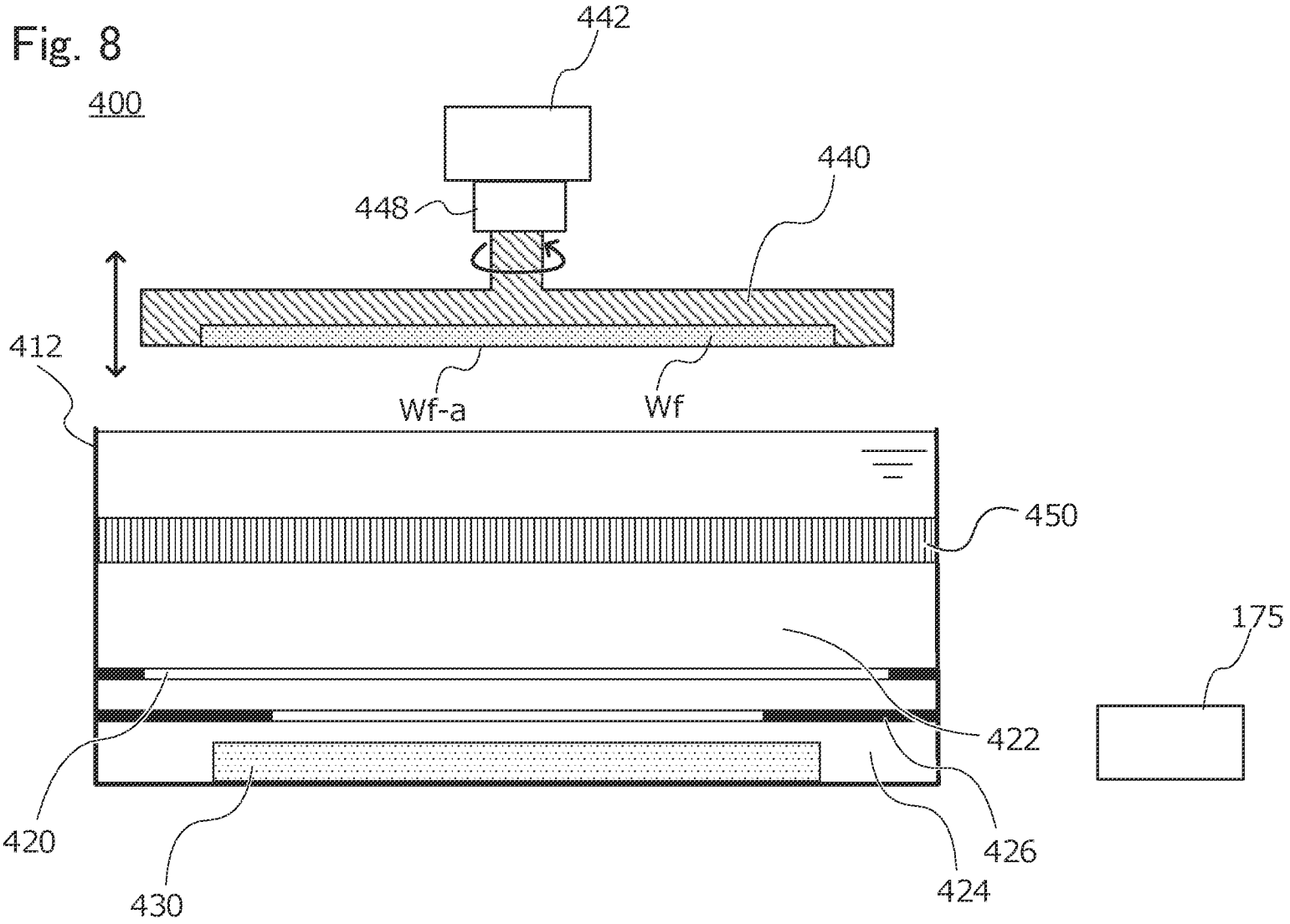
FIG. 8 is a longitudinal cross-sectional view schematically showing a configuration of a plating module according to a second embodiment.

FIG. 8 is a longitudinal cross-sectional view schematically showing a configuration of a plating module 400 of a second embodiment. As shown in FIG. 8, in the second embodiment, a substrate Wf is held so that a surface to be plated of the substrate Wf faces in a vertically downward direction. In the second embodiment, a circular substrate will be described as an example of the substrate Wf, and the substrate Wf may be a rectangular substrate in the same manner as in the first embodiment.

The plating module 400 of the second embodiment includes a plating tank 410 for accommodating a plating solution. The plating tank 410 includes a cylindrical inner tank 412 having an upper surface opened, and an unshown outer tank provided around the inner tank 412 to be able to accumulate the plating solution overflowing from an upper edge of the inner tank 412. The plating module 400 of the second embodiment is controlled by a controller 175 in the same manner as in the plating module 10 of the first embodiment.

The plating module 400 includes a substrate holder 440 for holding the substrate Wf in a state where the surface to be plated is oriented downward. The substrate holder 440 includes a power feed contact for feeding power to the substrate Wf from an unshown power source. The plating module 400 includes a lifting/lowering mechanism 442 for lifting and lowering the substrate holder 440. In one embodiment, the plating module 400 includes a rotation mechanism 448 that rotates the substrate holder 440 about a vertical axis. The lifting/lowering mechanism 442 and the rotation mechanism 448 can be realized by a known mechanism such as a motor.

The plating module 400 includes a membrane 420 that separates an interior of the inner tank 412 in an up-down direction. The interior of the inner tank 412 is partitioned into a cathode region 422 and an anode region 424 by the membrane 420. The cathode region 422 and the anode region 424 are each filled with the plating solution. In the present embodiment, an example where the membrane 420 is provided has been described, and the membrane 420 does not have to be provided.

An anode 430 is provided on a bottom surface of the inner tank 412 of the anode region 424. Further, an anode mask 426 for adjusting electrolysis between the anode 430 and the substrate Wf is disposed in the anode region 424. The anode mask 426 is a substantially plate-shaped member made of, for example, a dielectric material, and is provided on a front surface of (above) the anode 430. The anode mask 426 is configured so that an opening dimension can be changed by an adjustment mechanism 28 (not shown in FIG. 8) in the same manner as in the anode mask 25 of the first embodiment. However, the plating module 400 of the second embodiment does not have to include the adjustment mechanism 28 (not shown in FIG. 8) and may have the opening dimension of the anode mask 426 unchanged.

In the cathode region 422, a resistor 450 facing the membrane 420 is disposed. The resistor 450 is a member for achieving uniformity of plating processing on the surface to be plated of the substrate Wf. However, the plating module 400 is not limited to this example and does not have to include the resistor 450.

In the plating module 400 of the second embodiment, the substrate Wf is exposed to the plating solution by immersing the substrate Wf in the plating solution in the cathode region 422 by use of the lifting/lowering mechanism 442. The plating module 400 can subject the surface to be plated of the substrate Wf to plating processing by applying a voltage between the anode 430 and the substrate Wf in this state. In one embodiment, the plating processing is performed while rotating the substrate holder 440 by use of the rotation mechanism 448. The plating processing precipitates a conductive film (plating film) on the surface to be plated of the substrate.

Also, in the second embodiment, in the same manner as in the first embodiment, the controller 175 may calculate an amount of electrolysis in the anode 430 while the anode 430 is in use (total amount of electrolysis in the anode) and adjust an opening diameter of the anode mask 426 based on the calculated amount of electrolysis. Thereby, variations in uniformity of the plating film formed on the substrate Wf with the use of the anode 430 can be inhibited from being generated, and improvement of the uniformity of the plating film can be achieved, in the same manner as in the first embodiment.

In the plating module 400 of the second embodiment, the controller 175 may calculate the total amount of electrolysis in the anode and adjust a holding position of the substrate Wf (stop position of the substrate holder 440) by driving the lifting/lowering mechanism 442 based on the calculated amount of electrolysis. As an example, a relationship between the total amount of electrolysis in the anode and the holding position of the substrate Wf is predetermined and prestored in a memory 175B of the controller 175. Here, the relationship between the total amount of electrolysis in the anode and the holding position of the substrate Wf may be stored in the memory 175B, as a map, table, or relational expression, as an example. Then, the controller 175 derives the holding position of the substrate Wf (stop position of the substrate holder 440) based on the total amount of electrolysis in the anode and the relationship stored in the memory 175B, and outputs a drive command to the lifting/lowering mechanism 442. The relationship between the total amount of electrolysis in the anode and the holding position of the substrate Wf may be suitably determined by experiment, simulation, or the like. As an example, the larger the total amount of electrolysis in the anode is, the more the holding position of the substrate Wf may be moved downward (in a direction approaching the anode 21). In such a case, the holding position of the substrate Wf may smoothly change to a tendency that the larger the total amount of electrolysis in the anode is, the lower the holding position becomes (in the direction approaching the anode 21) or may change stepwise in two or more steps. Even by such control, variations in uniformity of the plating film formed on the substrate Wf with the use of the anode 430 can be inhibited from being generated.

<Modification>

In the above embodiments, the opening dimension of the anode mask 25 is adjusted based on the total amount of electrolysis in the anode. However, the controller 175 may adjust the diameter of the second opening 30*a* of the regulation plate 30 based on the total amount of electrolysis in the anode instead of or in addition to adjusting the opening dimension of the anode mask 25. In this case, as an example, a relationship between the total amount of electrolysis in the anode and the diameter of the second opening 30*a* of the regulation plate 30 may be predetermined and prestored in the memory 175B, and the diameter of the second opening 30*a* of the regulation plate 30 may be derived based on the relationship and the total amount of electrolysis in the anode, to drive the adjustment mechanism 28. In such an example, in the same manner as in the above-described embodiments, it is considered that variations in uniformity of the plating film formed on the substrate Wf with the use of the anode 21 can be inhibited from being generated.

Although the embodiments of the present invention have been described above, the above-described embodiments of the invention are intended to facilitate understanding of the present invention and do not limit the present invention. The present invention can be changed and improved without departing from the gist thereof, and needless to say, the present invention includes equivalents thereto. Further, within a range of being able to solve at least a part of the above-described problem or a range of exhibiting at least a part of effect, any combination or omission of the respective components described in the claims and the specification is possible. Furthermore, not only a semiconductor wafer but also a glass substrate or a printed wiring substrate can be used as the substrate that is the object to be plated.

The present invention can be described also as the following forms.

[Form 1] According to Form 1, a plating apparatus is provided, and the plating apparatus includes a plating tank, a substrate holder for holding a substrate, an anode holder disposed in the plating tank to face the substrate held in the substrate holder, the anode holder being configured to hold a soluble anode, an anode mask attached to the anode holder, the anode mask having an opening through which a current flowing between the anode and the substrate passes, an adjustment mechanism configured to adjust an opening dimension of the anode mask, and a controller that controls the adjustment mechanism based on an amount of electrolysis in the anode while the anode is in use.

According to Form 1, the improvement of the uniformity of a plating film formed on the substrate can be achieved.

[Form 2] According to Form 2, in Form 1, the controller sets the opening dimension by applying the amount of electrolysis to a predetermined relationship between the amount of electrolysis in the anode while the anode is in use and the opening dimension of the anode mask to control the adjustment mechanism.

[Form 3] According to Form 3, in Form 1 or 2, the controller controls the adjustment mechanism to decrease the opening dimension of the anode mask as the amount of electrolysis in the anode while the anode is in use increases. This is based on the fact that the larger the amount of electrolysis in the anode while the anode is in use is, the larger the dissolution amount of the anode becomes.

[Form 4] According to Form 4, in Forms 1 to 3, the plating apparatus further includes: a regulation plate provided between the anode mask and the substrate holder, the regulation plate having an opening through which a current flowing between the anode and the substrate passes, the adjustment mechanism is configured to adjust the opening dimension of the anode mask and an opening dimension of the regulation plate, and the controller controls the adjustment mechanism based on the amount of electrolysis in the anode while the anode is in use. According to Form 4, the improvement of the uniformity of the plating film formed on the substrate can be further achieved.

[Form 5] According to Form 5, in Forms 1 to 4, the substrate holder is configured to hold the substrate in a state where a surface to be plated is oriented downward in the plating tank.

[Form 6] According to Form 6, in Forms 1 to 4, the substrate holder is configured to hold the substrate in a state where a surface to be plated is oriented to a side in the plating tank.

[Form 7] According to Form 7, a plating method in a plating apparatus is provided, the plating apparatus includes a plating tank, a substrate holder for holding a substrate, an anode holder disposed in the plating tank to face the substrate held in the substrate holder, the anode holder being configured to hold a soluble anode, and an anode mask attached to the anode holder, the anode mask having an opening through which a current flowing between the anode and the substrate passes, and the plating method includes calculating an amount of electrolysis in the anode while the anode is in use, and adjusting an opening dimension of the anode mask based on the calculated amount of electrolysis.

According to Form 7, in the same manner as in Form 1, the improvement of the uniformity of the plating film formed on the substrate can be achieved.

Although the embodiments of the present invention have been described above, the above-described embodiments of the invention are intended to facilitate the understanding of the present invention and do not limit the present invention. The present invention can be changed and improved without departing from the gist thereof, and needless to say, the present invention includes the equivalents thereto. Further, within a range of being able to solve at least a part of the above-described problem or a range of exhibiting at least a part of effect, any combination of the embodiments and the modification is possible, and any combination or omission of the respective components described in the claims and the specification is possible.

REFERENCE SIGNS LIST

10 plating module
11 substrate holder
20 anode holder
21 anode
25 anode mask
25*a* first opening
28 adjustment mechanism
30 regulation plate
30*a* second opening
50 plating tank
52 plating processing tank
90 plating power source
92 current sensor
175 controller
175A CPU
175B memory
175C control unit
400 module
410 plating tank
420 membrane
426 anode mask
430 anode
440 substrate holder
442 lifting/lowering mechanism
448 rotation mechanism
450 resistor

The invention claimed is:

1. A plating apparatus comprising:
a plating tank;
a substrate holder for holding a substrate;
an anode holder disposed in the plating tank to face the substrate held in the substrate holder, the anode holder being configured to hold a soluble anode;
an anode mask attached to the anode holder, the anode mask having an opening through which a current flowing between the anode and the substrate passes;
an adjustment mechanism configured to adjust an opening dimension of the anode mask; and
a controller that controls the adjustment mechanism based on an amount of electrolysis in the anode while the anode is in use.

2. The plating apparatus according to claim 1, wherein the controller sets the opening dimension by applying the amount of electrolysis to a predetermined relationship between the amount of electrolysis in the anode while the anode is in use and the opening dimension of the anode mask to control the adjustment mechanism.

3. The plating apparatus according to claim 1, wherein the controller controls the adjustment mechanism to decrease the opening dimension of the anode mask as the amount of electrolysis in the anode while the anode is in use increases.

4. The plating apparatus according to claim 1, further comprising:
a regulation plate provided between the anode mask and the substrate holder, the regulation plate having an opening through which a current flowing between the anode and the substrate passes, wherein the adjustment mechanism is configured to adjust the opening dimension of the anode mask and an opening dimension of the regulation plate, and the controller controls the adjustment mechanism based on the amount of electrolysis in the anode while the anode is in use.

5. The plating apparatus according to claim 1, wherein the substrate holder is configured to hold the substrate in a state where a surface to be plated is oriented downward in the plating tank.

6. The plating apparatus according to claim 1, wherein the substrate holder is configured to hold the substrate in a state where a surface to be plated is oriented to a side in the plating tank.

7. A plating method in a plating apparatus, the plating apparatus comprising:

a plating tank;

a substrate holder for holding a substrate;

an anode holder disposed in the plating tank to face the substrate held in the substrate holder, the anode holder being configured to hold a soluble anode; and an anode mask attached to the anode holder, the anode mask having an opening through which a current flowing between the anode and the substrate passes, the plating method comprising:

calculating an amount of electrolysis in the anode while the anode is in use; and adjusting an opening dimension of the anode mask based on the calculated amount of electrolysis.

* * * * *